US010923029B2

(12) United States Patent
Chen et al.

(10) Patent No.: US 10,923,029 B2
(45) Date of Patent: Feb. 16, 2021

(54) PIXEL CIRCUIT

(71) Applicant: Au Optronics Corporation, Hsinchu (TW)

(72) Inventors: Yi-Chiung Chen, Hsinchu (TW); Mao-Hsun Cheng, Tainan (TW)

(73) Assignee: Au Optronics Corporation, Hsinchu (TW)

( * ) Notice: Subject to any disclaimer, the term of this patent is extended or adjusted under 35 U.S.C. 154(b) by 0 days.

(21) Appl. No.: 16/355,846

(22) Filed: Mar. 18, 2019

(65) Prior Publication Data

US 2019/0325824 A1 Oct. 24, 2019

(30) Foreign Application Priority Data

Apr. 19, 2018 (TW) ..... 107113415 A

(51) Int. Cl.
*G09G 3/32* (2016.01)
*G09G 3/3233* (2016.01)
*G09G 3/3266* (2016.01)

(52) U.S. Cl.
CPC ..... *G09G 3/3233* (2013.01); *G09G 3/3266* (2013.01); *G09G 2300/0426* (2013.01); *G09G 2300/0439* (2013.01); *G09G 2300/0809* (2013.01)

(58) Field of Classification Search
CPC ..... G09G 3/3233; G09G 3/3266; G09G 2300/0809; G09G 2300/0439; G09G 2300/0426; G09G 2300/0861; G09G 2300/0842; G09G 2300/0819
See application file for complete search history.

(56) References Cited

U.S. PATENT DOCUMENTS

| | | | |
|---|---|---|---|
| 8,502,757 | B2 | 8/2013 | Liu et al. |
| 8,553,024 | B2 | 10/2013 | Tsai et al. |
| 8,564,512 | B2 | 10/2013 | Chung |
| 9,343,014 | B2 | 5/2016 | Huang et al. |
| 10,255,849 | B2 | 4/2019 | Ma |
| 2012/0235972 | A1 | 9/2012 | Liu et al. |
| 2016/0035276 | A1 | 2/2016 | Yin et al. |
| 2016/0125808 | A1 | 5/2016 | Hsu et al. |
| 2016/0148566 | A1 | 5/2016 | Tseng et al. |
| 2016/0217741 | A1 | 7/2016 | Tseng et al. |

(Continued)

FOREIGN PATENT DOCUMENTS

| | | |
|---|---|---|
| CN | 104078005 | 10/2014 |
| CN | 104751779 | 7/2015 |

(Continued)

*Primary Examiner* — Carolyn R Edwards
(74) *Attorney, Agent, or Firm* — JCIPRNET

(57) ABSTRACT

A pixel circuit including a light-emitting element, a first transistor, a second transistor, a third transistor, a fourth transistor, a fifth transistor, a sixth transistor, a seventh transistor, an eighth transistor and a storage capacitor is provided. The third transistor is coupled to the second transistor. The fourth transistor is coupled to the second transistor. The storage capacitor is coupled between the first transistor and the fourth transistor. The fifth transistor is coupled to the fourth transistor. The sixth transistor is coupled to the fourth transistor. The seventh transistor is coupled to the fourth transistor and the light-emitting element. The eighth transistor is coupled to the first transistor.

17 Claims, 4 Drawing Sheets

(56) References Cited

U.S. PATENT DOCUMENTS

| | | | | |
|---|---|---|---|---|
| 2016/0232836 | A1* | 8/2016 | Yang | G09G 3/3233 |
| 2016/0307504 | A1* | 10/2016 | Hung | G09G 3/3233 |
| 2016/0351123 | A1* | 12/2016 | Qing | G09G 3/3233 |
| 2017/0092193 | A1 | 3/2017 | Na et al. | |
| 2018/0151115 | A1 | 5/2018 | Tseng et al. | |

FOREIGN PATENT DOCUMENTS

| | | |
|---|---|---|
| CN | 103700342 | 3/2017 |
| CN | 106531077 | 3/2017 |
| CN | 107591124 | 1/2018 |

* cited by examiner

PIXEL CIRCUIT

CROSS-REFERENCE TO RELATED APPLICATION

This application claims the priority benefit of Taiwan application Ser. No. 107113415, filed on Apr. 19, 2018. The entirety of the above-mentioned patent application is hereby incorporated by reference herein and made a part of this specification.

BACKGROUND OF THE INVENTION

Field of the Invention

The invention relates to a pixel circuit, and particularly relates to a pixel circuit with a light-emitting element.

Description of Related Art

Due to a characteristic of self-luminous, self-luminous display panels have become a focus in development of new generation display panels, such as Organic Light-Emitting Diode (OLED) display panels or μLED. However, constrained by the characteristic that a power supply is varied along with a load, a current used for driving a light-emitting element in a pixel circuit is correspondingly varied, such that a brightness of the light-emitting element is slightly different with an expected brightness. Therefore, when the current used for driving the light-emitting element cannot reach an expected value, it may influence display quality of the self-luminous display panel.

SUMMARY OF THE INVENTION

The invention is directed to a pixel circuit, which is adapted to ameliorate display quality of a self-luminous display panel.

The invention provides a pixel circuit including a light-emitting element, a first transistor, a second transistor, a third transistor, a fourth transistor, a fifth transistor, a sixth transistor, a seventh transistor, an eighth transistor and a storage capacitor. The light-emitting element has an anode and a cathode for receiving a system low voltage. The first transistor has a first terminal receiving a system high voltage, a control terminal receiving a first light-emitting signal and a second terminal. The second transistor has a first terminal receiving the system high voltage, a control terminal receiving the first light-emitting signal and a second terminal. The third transistor has a first terminal coupled to the second terminal of the second transistor, a control terminal receiving a first scan signal and a second terminal receiving a reference voltage. The fourth transistor has a first terminal coupled to the second terminal of the second transistor, a control terminal and a second terminal. The storage capacitor is coupled between the second terminal of the first transistor and the control terminal of the fourth transistor. The fifth transistor has a first terminal coupled to the control terminal of the fourth transistor, a control terminal receiving the first scan signal and a second terminal coupled to the second terminal of the fourth transistor. The sixth transistor has a first terminal coupled to the control terminal of the fourth transistor, a control terminal receiving a second scan signal and a second terminal receiving a low level voltage. The seventh transistor has a first terminal coupled to the second terminal of the fourth transistor, a control terminal receiving a second light-emitting signal and a second terminal coupled to the anode of the light-emitting element. The eighth transistor has a first terminal receiving a data voltage, a control terminal receiving the first scan signal and a second terminal coupled to the second terminal of the first transistor.

Based on the above description, in the pixel circuit of the embodiment, the system high voltage OVDD is simultaneously sent to the second terminal of the fourth transistor and the storage capacitor, so that fluctuation of the system high voltage does not influence a current flowing through the fourth transistor.

In order to make the aforementioned and other features and advantages of the invention comprehensible, several exemplary embodiments accompanied with figures are described in detail below.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF EMBODIMENTS

Figure 1A:
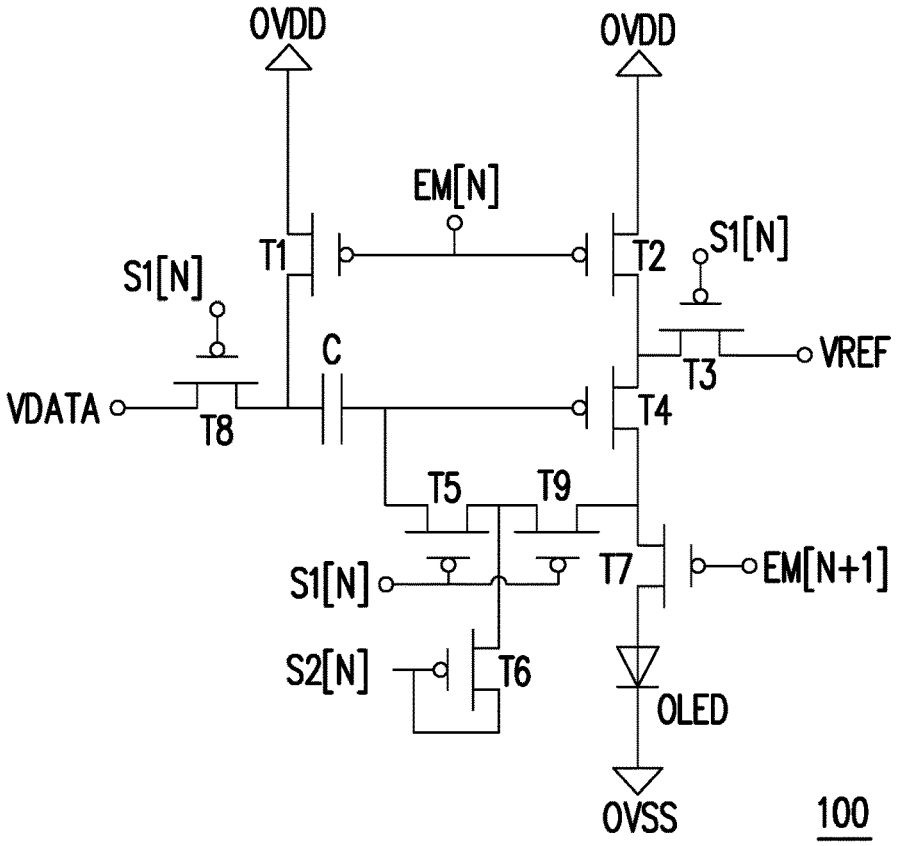
FIG. 1A is a circuit schematic diagram of a pixel circuit according to a first embodiment of the invention.

FIG. 1A is a circuit schematic diagram of a pixel circuit according to a first embodiment of the invention. Referring to FIG. 1A, in the embodiment, the pixel circuit 100 includes a light-emitting element (for example, an Organic Light-Emitting Diode OLED), a storage capacitor C, a first transistor T1, a second transistor T2, a third transistor T3, a fourth transistor T4, a fifth transistor T5, a sixth transistor T6, a seventh transistor T7, an eighth transistor T8 and a ninth transistor T9.

The organic light-emitting diode OLED has an anode and a cathode receiving a system low voltage OVSS. The first transistor T1 has a first terminal receiving a system high voltage OVDD, a control terminal receiving a first light-emitting signal EM[N] and a second terminal, where N is an index. The second transistor T2 has a first terminal receiving the system high voltage OVDD, a control terminal receiving the first light-emitting signal EM[N] and a second terminal. The third transistor T3 has a first terminal coupled to the second terminal of the second transistor T2, a control terminal receiving a first scan signal S1[N] and a second terminal receiving a reference voltage VREF.

The fourth transistor T4 has a first terminal coupled to the second terminal of the second transistor T2, a control terminal and a second terminal. The storage capacitor C is coupled between the second terminal of the first transistor T1 and the control terminal of the fourth transistor T4. The fifth transistor T5 has a first terminal coupled to the control terminal of the fourth transistor T4, a control terminal receiving the first scan signal S1[N] and a second terminal. The sixth transistor T6 has a first terminal coupled to the second terminal of the fifth transistor T5, a control terminal receiving a second scan signal S2[N] and a second terminal receiving the second scan signal S2[N].

The seventh transistor T7 has a first terminal coupled to the second terminal of the fourth transistor T4, a control terminal receiving a second light-emitting signal EM [N+1] and a second terminal coupled to the anode of the organic light-emitting diode OLED. The eighth transistor T8 has a first terminal receiving a data voltage VDATA, a control terminal receiving the first scan signal S1[N] and a second terminal coupled to the second terminal of the first transistor T1. The ninth transistor T9 has a first terminal coupled to the second terminal of the fifth transistor T5, a control terminal receiving the first scan signal S1[N] and a second terminal coupled to the second terminal of the fourth transistor T4, where the reference voltage VREF is between the system high voltage OVDD and the system low voltage OVSS.

Figure 1B:
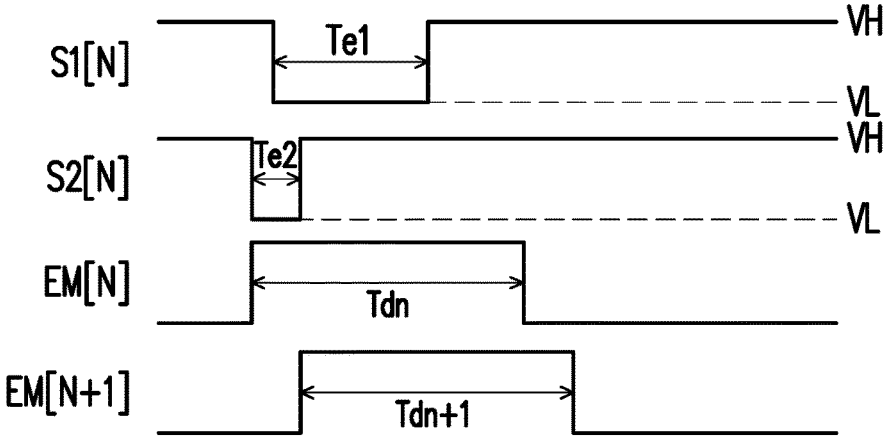
FIG. 1B is a driving waveform diagram of a pixel circuit according to the first embodiment of the invention.

FIG. 1B is a driving waveform diagram of the pixel circuit according to the first embodiment of the invention. Referring to FIG. 1A and FIG. 1B, in the embodiment, an enabling period Te1 of the first scan signal S1[N] is longer than an enabling period Te2 of the second scan signal S2[N], the enabling period Te2 of the second scan signal S2[N] is earlier than the enabling period Te1 of the first scan signal S1[N], and the enabling period Te2 of the second scan signal S2[N] is partially overlapped with the enabling period Te1 of the first scan signal S1[N].

The enabling period Te1 of the first scan signal S1[N] and the enabling period Te2 of the second scan signal S2[N] are completely located within a disabling period Tdn of the first light-emitting signal EM[N]. Namely, the pixel circuit 100 does not emit light during scanning and data writing operations. A time length of the disabling period Tdn of the first light-emitting signal EM[N] is substantially equal to a time length of a disabling period Tdn+1 of the second light-emitting signal EM[N+1], and the disabling period Tdn of the first light-emitting signal EM[N] is earlier than the disabling period Tdn+1 of the second light-emitting signal EM[N+1].

During the enabling period Te2, the first transistor T1 and the second transistor T2 are turned off, and the third transistor T3, the fourth transistor T4, the fifth transistor T5, the sixth transistor T6, the seventh transistor T7, the eighth transistor T8 and the ninth transistor T9 are turned on. In this case, the second terminal of the fifth transistor T5 is coupled to the second terminal of the fourth transistor T4 through the turned-on ninth transistor T9, i.e. the first terminal of the sixth transistor T6 is coupled to the control terminal of the fourth transistor T4 through the turned on fifth transistor T5, and the first terminal of the sixth transistor T6 is coupled to the second terminal of the fourth transistor T4 through the turned-on ninth transistor T9. Therefore, the control terminal of the fourth transistor T4 and the anode of the organic light-emitting diode OLED are set to VL+Vth, where VL is the low level voltage of the second scan signal S2[N], and Vth is a turn-on threshold voltage of the transistor. Moreover, the storage capacitor C receives the data voltage VDATA and is started charging.

During the enabling period Te1 after the enabling period Te2, the first transistor T1, the second transistor T2, the sixth transistor T6 and the seventh transistor T7 are turned off, and the third transistor T3, the fourth transistor T4, the fifth transistor T5, the eighth transistor T8 and the ninth transistor T9 are turned on. In this case, the reference voltage VREF is sent to the control terminal of the fourth transistor T4 through the turned-on third transistor T3, fourth transistor T4, fifth transistor T5 and ninth transistor T9, such that the control terminal of the fourth transistor T4 is VREF−Vth. Moreover, a high level voltage VH of the second scan signal S2[N] is greater than the system high voltage OVDD, so that a leakage current of the sixth transistor T6 is suppressed. A cross voltage stored by the storage capacitor C is VDATA−VREF+Vth.

After the disabling period Tdn+1, the first transistor T1, the second transistor T2, the fourth transistor T4 and the seventh transistor T7 are turned on, and the third transistor T3, the fifth transistor T5, the sixth transistor T6, the eighth transistor T8 and the ninth transistor T9 are turned off. Since the cross voltage stored by the storage capacitor C is VDATA−VREF+Vth, a current flowing through the fourth transistor T4 is only related to the data voltage VDATA and the reference voltage VREF.

In the embodiment, the pixel circuit 100 has following characteristics: during a light-emitting phase (i.e. after the disabling period Tdn+1), the system high voltage OVDD may be simultaneously transmitted to the second terminal of the fourth transistor T4 and the storage capacitor C, so that fluctuation of the system high voltage OVDD does not influence the current flowing through the fourth transistor T4, i.e. the fluctuation of the system high voltage OVDD may be completely compensated; only one reference voltage VREF is required; the control terminal of the fourth transistor T4 is charged through the reference voltage VREF, so as to compensate the turn-on threshold voltage Vth; the anode of the organic light-emitting diode OLED is reset through the sixth transistor T6, the seventh transistor T7 and the ninth transistor T9, which is not easy to leak electricity to cause slight bright spots.

According to the above description, the reference voltage VREF influencing the current flowing through the fourth transistor T4 is a voltage level of the reference voltage VREF of a compensation phase (i.e. in the enabling period Te1), and current overload of each row of the pixel circuit in the compensation phase is the same, so that the reference voltage is more stable compare to the situation of charging through the system high voltage OVDD (the system high voltage OVDD is required to simultaneously provide a compensation current and a light-emitting current), so that fluctuation of the reference voltage VREF does not influence the current flowing through the fourth transistor T4. Moreover, during a light-emitting phase (i.e. after the disabling period Tdn+1), a voltage level of the control terminal of the fourth transistor T4 is increased along with time, which may mitigate a flickering phenomenon in a low frequency operation. In this way, the display quality of the self-luminous display panel is improved.

Figure 2:
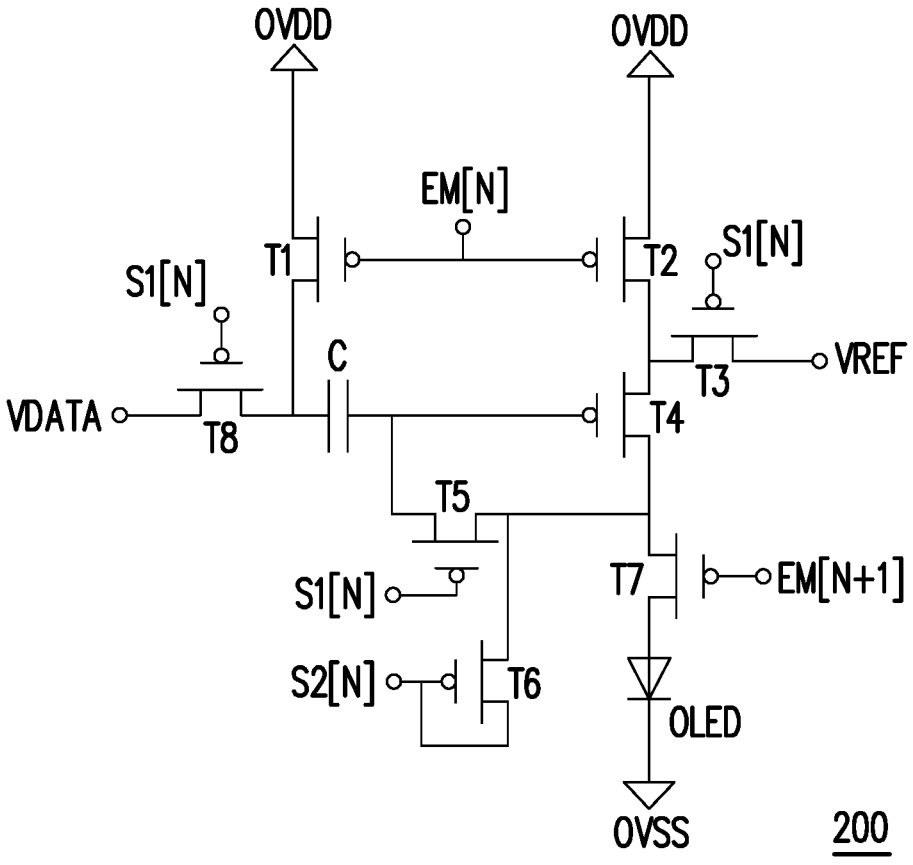
FIG. 2 is a circuit schematic diagram of a pixel circuit according to a second embodiment of the invention.

FIG. 2 is a circuit schematic diagram of a pixel circuit according to a second embodiment of the invention. Referring to FIG. 1 and FIG. 2, the pixel circuit 200 is substantially the same to the pixel circuit 100, and a difference there between is that the transistor T9 is omitted in the pixel circuit 200, i.e. the second terminal of the fifth transistor T5 is directly coupled to the second terminal of the fourth transistor T4, and the first terminal of the sixth transistor T6 is directly coupled to the second terminal of the fourth transistor T4.

Figure 3:
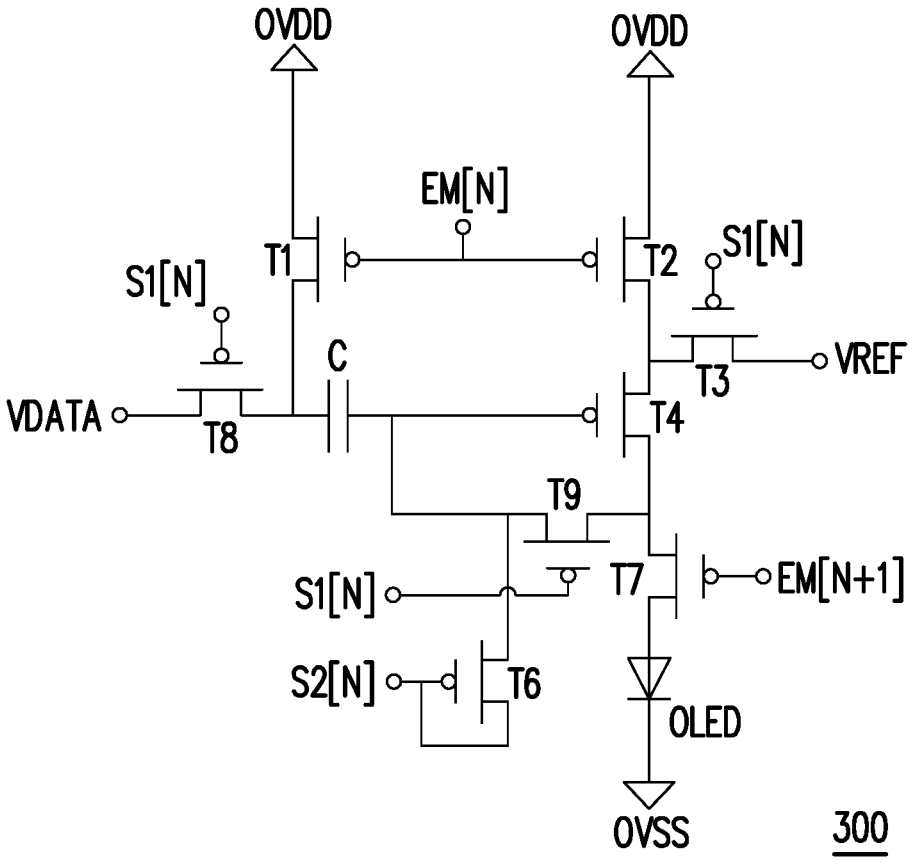
FIG. 3 is a circuit schematic diagram of a pixel circuit according to a third embodiment of the invention.

FIG. 3 is a circuit schematic diagram of a pixel circuit according to a third embodiment of the invention. Referring to FIG. 1 and FIG. 3, the pixel circuit 300 is substantially the same to the pixel circuit 100, and a difference there between is that the transistor T5 is omitted in the pixel circuit 300, i.e. the first terminal of the ninth transistor T9 is directly coupled to the control terminal of the fourth transistor T4, and the first terminal of the sixth transistor T6 is directly coupled to the control terminal of the fourth transistor T4.

Figure 4:
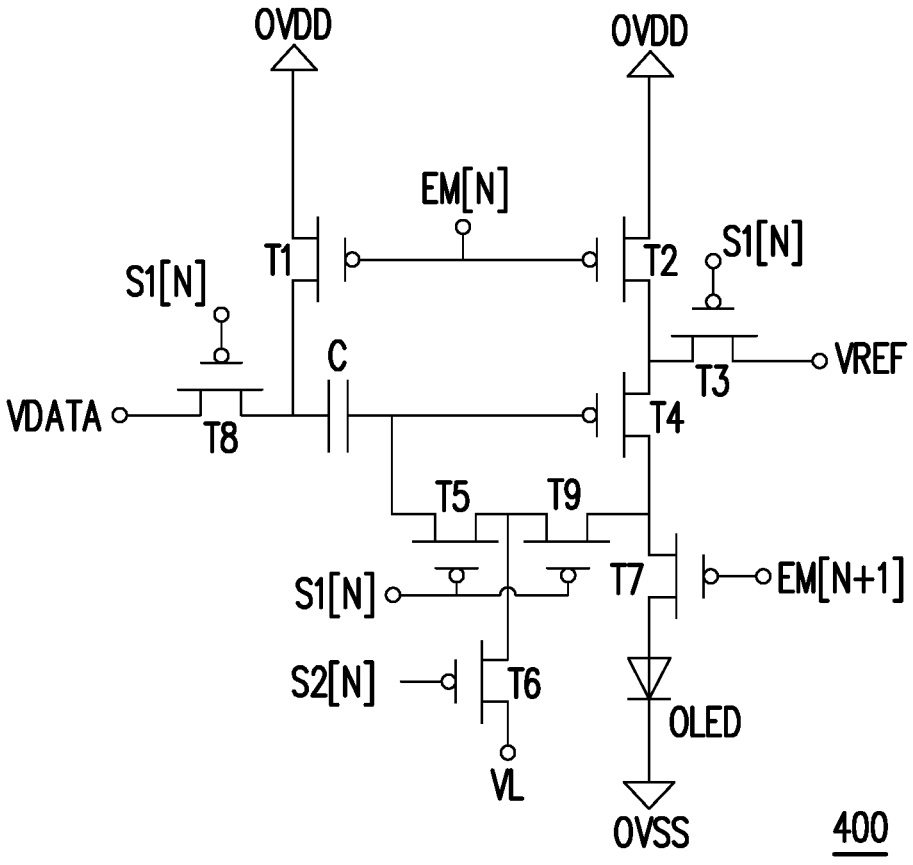
FIG. 4 is a circuit schematic diagram of a pixel circuit according to a fourth embodiment of the invention.

FIG. 4 is a circuit schematic diagram of a pixel circuit according to a fourth embodiment of the invention. Referring to FIG. 1 and FIG. 4, the pixel circuit 400 is substantially the same to the pixel circuit 100, and a difference there between is that the control terminal of the sixth transistor T6 of the pixel circuit 400 is used for receiving the second scan signal S2[N]; and the second terminal of the sixth transistor T6 is used for receiving a constant voltage, which is, for example, a low level voltage VL, such that the sixth transistor T6 may pull down a voltage level between the fifth transistor T5 and the ninth transistor T9 during the enabling period Te2 of the second scan signal S2[N].

In summary, in the pixel circuit of the embodiment, the system high voltage OVDD is simultaneously sent to the second terminal of the fourth transistor and the storage capacitor, so that fluctuation of the system high voltage does not influence the current flowing through the fourth transistor. Moreover, the reference voltage influencing the current flowing through the fourth transistor is the voltage level of the compensation phase, which is more stable compare to the situation of charging through the system high voltage, so that fluctuation of the reference voltage does not influence the current flowing through the fourth transistor.

It will be apparent to those skilled in the art that various modifications and variations can be made to the structure of the invention without departing from the scope or spirit of the invention. In view of the foregoing, it is intended that the invention cover modifications and variations of this invention provided they fall within the scope of the following claims and their equivalents.

What is claimed is:

1. A pixel circuit, comprising:

a light-emitting element, having an anode and a cathode receiving a system low voltage;

a first transistor, having a first terminal receiving a system high voltage, a control terminal receiving a first light-emitting signal, and a second terminal;

a second transistor, having a first terminal receiving the system high voltage, a control terminal receiving the first light-emitting signal and a second terminal;

a third transistor, having a first terminal coupled to the second terminal of the second transistor, a control terminal receiving a first scan signal, and a second terminal receiving a reference voltage;

a fourth transistor, having a first terminal directly connected to the second terminal of the second transistor, a control terminal and a second terminal;

a storage capacitor, directly connected between the second terminal of the first transistor and the control terminal of the fourth transistor;

a fifth transistor, having a first terminal coupled to the control terminal of the fourth transistor, a control terminal receiving the first scan signal and a second terminal coupled to the second terminal of the fourth transistor;

a sixth transistor, having a first terminal coupled to the control terminal of the fourth transistor, a control terminal receiving a second scan signal, and a second terminal receiving a low level voltage or the second scan signal;

a seventh transistor, having a first terminal directly connected to the second terminal of the fourth transistor, a control terminal receiving a second light-emitting signal, and a second terminal directly connected to the anode of the light-emitting element; and an eighth transistor, having a first terminal receiving a data voltage, a control terminal receiving the first scan signal, and a second terminal coupled to the second terminal of the first transistor, wherein an enabling period of the first scan signal is longer than an enabling period of the second scan signal, the enabling period of the second scan signal is earlier than the enabling period of the first scan signal, and the enabling period of the second scan signal is partially overlapped with the enabling period of the first scan signal.

2. The pixel circuit as claimed in claim 1, wherein the first terminal of the sixth transistor is directly coupled to the control terminal of the fourth transistor.

3. The pixel circuit as claimed in claim 1, wherein the first terminal of the sixth transistor is coupled to the second terminal of the fifth transistor, so as to be coupled to the control terminal of the fourth transistor through the turned-on fifth transistor.

4. The pixel circuit as claimed in claim 3, further comprising:

a ninth transistor, having a first terminal coupled to the second terminal of the fifth transistor, a control terminal receiving the first scan signal, and a second terminal coupled to the second terminal of the fourth transistor.

5. The pixel circuit as claimed in claim 1, wherein the second terminal of the sixth transistor is coupled to the second scan signal to receive the low level voltage of the second scan signal.

6. The pixel circuit as claimed in claim 1, wherein a high level voltage of the second scan signal is greater than the system high voltage.

7. The pixel circuit as claimed in claim 1, wherein the enabling period of the first scan signal and the enabling period of the second scan signal are completely within a disabling period of the first light-emitting signal.

8. The pixel circuit as claimed in claim 7, wherein a time length of the disabling period of the first light-emitting signal is substantially equal to a time length of a disabling period of the second light-emitting signal, and the disabling period of the first light-emitting signal is earlier than the disabling period of the second light-emitting signal.

9. The pixel circuit as claimed in claim 1, wherein the reference voltage is between the system high voltage and the system low voltage.

10. A pixel circuit, comprising:

a light-emitting element, having an anode and a cathode receiving a system low voltage;

a first transistor, having a first terminal receiving a system high voltage, a control terminal receiving a first light-emitting signal, and a second terminal;

a second transistor, having a first terminal receiving the system high voltage, a control terminal receiving the first light-emitting signal and a second terminal;

a third transistor, having a first terminal coupled to the second terminal of the second transistor, a control terminal receiving a first scan signal, and a second terminal receiving a reference voltage;

a fourth transistor, having a first terminal directly connected to the second terminal of the second transistor, a control terminal and a second terminal;

a storage capacitor, directly connected between the second terminal of the first transistor and the control terminal of the fourth transistor;

a fifth transistor, having a first terminal coupled to the control terminal of the fourth transistor, a control terminal receiving the first scan signal and a second terminal coupled to the second terminal of the fourth transistor;

a sixth transistor, having a first terminal coupled to the control terminal of the fourth transistor, a control terminal receiving a second scan signal, and a second terminal receiving a low level voltage or the second scan signal;

a seventh transistor, having a first terminal directly connected to the second terminal of the fourth transistor, a control terminal receiving a second light-emitting signal, and a second terminal directly connected to the anode of the light-emitting element; and an eighth transistor, having a first terminal receiving a data voltage, a control terminal receiving the first scan signal, and a second terminal coupled to the second terminal of the first transistor, wherein during an enabling period, the first transistor and the second transistor are turned off, and the third transistor, the fourth transistor, the fifth transistor, the sixth transistor, the seventh transistor, the eighth transistor and the ninth transistor are turned on, and wherein an enabling period of the first scan signal is longer than an enabling period of the second scan signal, the enabling period of the second scan signal is earlier than the enabling period of the first scan signal, and the enabling period of the second scan signal is partially overlapped with the enabling period of the first scan signal.

11. The pixel circuit as claimed in claim 10, wherein the first terminal of the sixth transistor is coupled to the second terminal of the fifth transistor, so as to be coupled to the control terminal of the fourth transistor through the turned-on fifth transistor.

12. The pixel circuit as claimed in claim 11, further comprising:

a ninth transistor, having a first terminal coupled to the second terminal of the fifth transistor, a control terminal receiving the first scan signal, and a second terminal coupled to the second terminal of the fourth transistor.

13. The pixel circuit as claimed in claim 10, wherein the second terminal of the sixth transistor is coupled to the second scan signal to receive the low level voltage of the second scan signal.

14. The pixel circuit as claimed in claim 10, wherein a high level voltage of the second scan signal is greater than the system high voltage.

15. The pixel circuit as claimed in claim 10, wherein the enabling period of the first scan signal and the enabling period of the second scan signal are completely within a disabling period of the first light-emitting signal.

16. The pixel circuit as claimed in claim 15, wherein a time length of the disabling period of the first light-emitting signal is substantially equal to a time length of a disabling period of the second light-emitting signal, and the disabling period of the first light-emitting signal is earlier than the disabling period of the second light-emitting signal.

17. The pixel circuit as claimed in claim 10, wherein the reference voltage is between the system high voltage and the system low voltage.

* * * * *